US005435281A

United States Patent [19]

Regueiro

[11] Patent Number: 5,435,281

[45] Date of Patent: Jul. 25, 1995

[54] CYLINDER HEAD CONSTRUCTION FOR INTERNAL COMBUSTION ENGINES

[75] Inventor: Jose F. Regueiro, Rochester Hills, Mich.

[73] Assignee: Chrysler Corporation, Highland Park, Mich.

[21] Appl. No.: 334,304

[22] Filed: Nov. 4, 1994

[51] Int. Cl.[6] ..... F02F 7/00

[52] U.S. Cl. ..... 123/195 H; 123/193.3

[58] Field of Search ..... 123/90, 27, 195 R, 195 H, 123/193.3

[56] References Cited

U.S. PATENT DOCUMENTS 5,150,675 9/1992 Murata ..... 123/193.5

*Primary Examiner*—Noah P. Kamen

*Attorney, Agent, or Firm*—Kenneth H. MacLean

[57] ABSTRACT

A cylinder head for an internal combustion engine, having an iron lower base part with inlet and exhaust ports and controlling valves therefor and an aluminum upper support for the camshaft and valve tappets. The upper part includes an open lattice work formed by spaced interconnected segments and curved sections extending between spaced bulkheads integral therewith that can be readily fastened to the base part to provide overhead support for the valve tappets. The lattice work has special expansion and contraction joints that connect into the bulkheads which mount the camshaft so that different rates of thermal expansion and contraction occurring between the lattice work and lower base part will cause deflection of the expansion joint and will not adversely effect the operation of the camshaft or the tappets carried by the bulkheads and lattice work.

6 Claims, 2 Drawing Sheets

CYLINDER HEAD CONSTRUCTION FOR INTERNAL COMBUSTION ENGINES

FIELD OF THE INVENTION

This invention relates to internal combustion engines with multiple-part heads, and more particularly to a new and improved temperature-compensating camshaft and tappet carrier forming part of the head of an engine.

DESCRIPTION OF RELATED ART

Prior to the present invention, various support-frame constructions have been devised as tappet and camshaft carriers for attachment to base portions of the heads of internal combustion engines. For example, in U.S. Pat. 5,080,057, issued Jan. 14, 1992, a die cast and machined carrier, comprising discrete upper and lower sections is secured to a cylinder head housing. When installed, the two-part carrier forms a web-like or latticed structure of ribs, struts, and annular sections for receiving and slidably supporting inverted bucket-shaped tappets of the intake and exhaust valves of an internal combustion engine, and for rotatably supporting the camshafts above the tappets. This multi-part carrier is a light-weight and stiff support member, bolted to a cylinder head housing, to provide a cylinder head assembly of high rigidity with the camshaft and tappets operatively mounted thereon.

Also prior to the present invention, different metals have been used for different major support components of a multiple-part head assembly for internal combustion engines. For example, in U.S. Pat. 4,291,650, issued Sep. 29, 1981, for "Cylinder Head for Compression-Ignition Internal Combustion Engine", a cylinder head having a lower body part of cast iron provides a base member to which an aluminum intermediate part having transverse supports for the camshaft is attached. This construction also has upper cam caps made of aluminum.

While the prior constructions provide for a lattice work type camshaft and tappet support, and for the use of different metals, for different major support components, the resultant assembly is a rigid structure that does not compensate for the differential rates of thermal expansion and contraction that may be experienced in vehicle engines, especially large engines, and vehicle operation. More particularly, the prior constructions do not provide dedicated thermal expansion and contraction connections or joints in a temperature compensated carrier for improving the operation of the valve tappets and camshafts over a wide range of temperatures.

In contrast to the prior constructions, the present invention provides a cylinder head for an internal combustion engine with a base component formed from iron to provide the upper end of the combustion chamber, the intake and exhaust ports and provide support for the intake and exhaust valves, fuel injector and sparking plug, if used. Furthermore, the invention features a unitized camshaft and tappet carrier adapted to be easily machined, handled and attached to the base of the cylinder head. This carrier is preferably made from aluminum, or aluminum alloy, for reducing the weight of the engine and to provide bearing surfaces for the tappets and camshaft journals. More particularly in this invention, this carrier comprises an open lattice work of interconnected segments to support the tappets for operation therein and camshaft supporting bulkheads integral with the lattice work for attachment to the iron lower base of the head. The bulkheads are spaced and interconnected by the lattice work that includes thermal expansion and contraction joints forming portions thereof strategically located so that the wide range of temperature variations, −60° F. to +350° F. for example, occurring in engine and vehicle operations do not cause damage to the lattice work or the bulkheads and resultantly detract from engine operation.

More particularly, this invention provides for a new and improved one-piece camshaft and tappet supporting carrier having lattice work of aluminum alloy or other light-weight material that can be easily secured to a block of cast iron forming a lower head part and having a lower coefficient of expansion than the lattice work. Importantly, in this invention, special provision is made for differential expansion and contraction rates of the block and lattice work. To this end, the lattice work has a discrete expansion section, or sections, that deflects and recovers to allow the lattice work to readily expand and contract at rates higher than that of the lower part of the head without any significant distortion or damage to of any of the lattice work or lower head part.

Another object of this invention is to provide a new and improved head assembly for an internal combustion engine having an iron base part in which intake and exhaust passages and valves are provided and featuring a one-piece carrier bulkhead and lattice work of aluminum alloy or equivalents thereof secured at spaced points to the base part that provides support for rotating camshafts and stroking tappets. The bulkheads are fastened by screws or otherwise secured to the iron base part with the lattice work extending therebetween and over the valves to provide the support for the valve tappets thereof. The lattice work accordingly comprises at least one tappet carrier and importantly incorporates a strategically located expansion-contraction section or sections so that differential rates of thermal expansion of the components of the head assembly will deflect the expansion joints and will not adversely distort other portions of the lattice work or any component of the head assembly.

These and other features, object and advantages of this invention will become more apparent from the accompanying drawings:

DETAILED DESCRIPTION OF THE DRAWINGS

Figure 1:
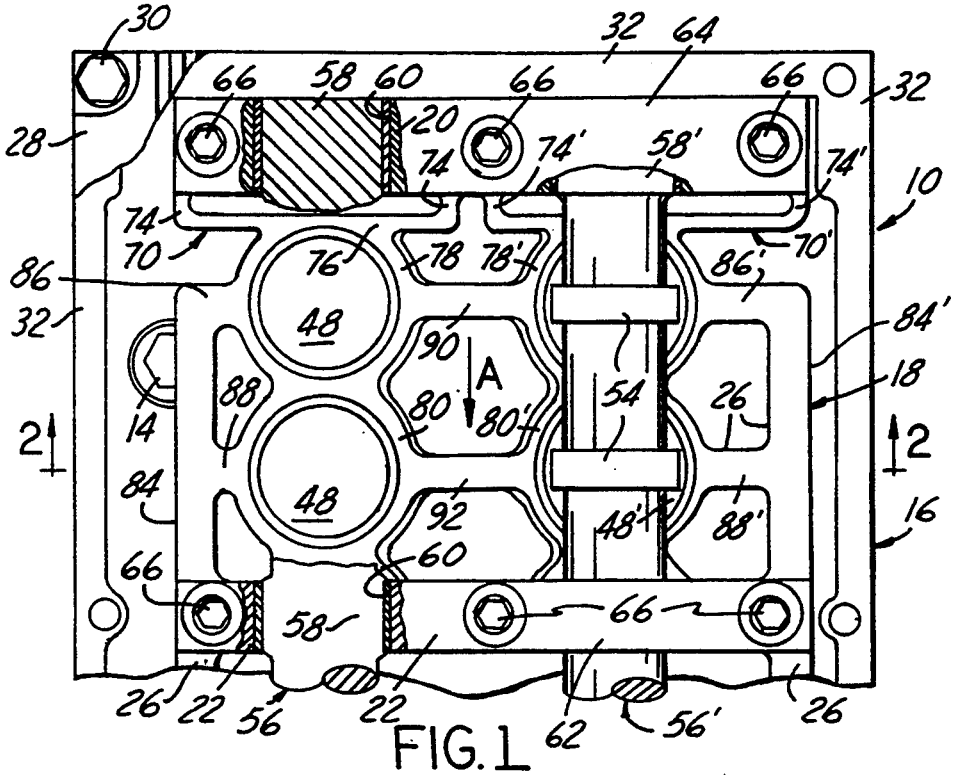
FIG. 1 is a top view of a portion of a cylinder head of an internal combustion engine.
Figure 2:
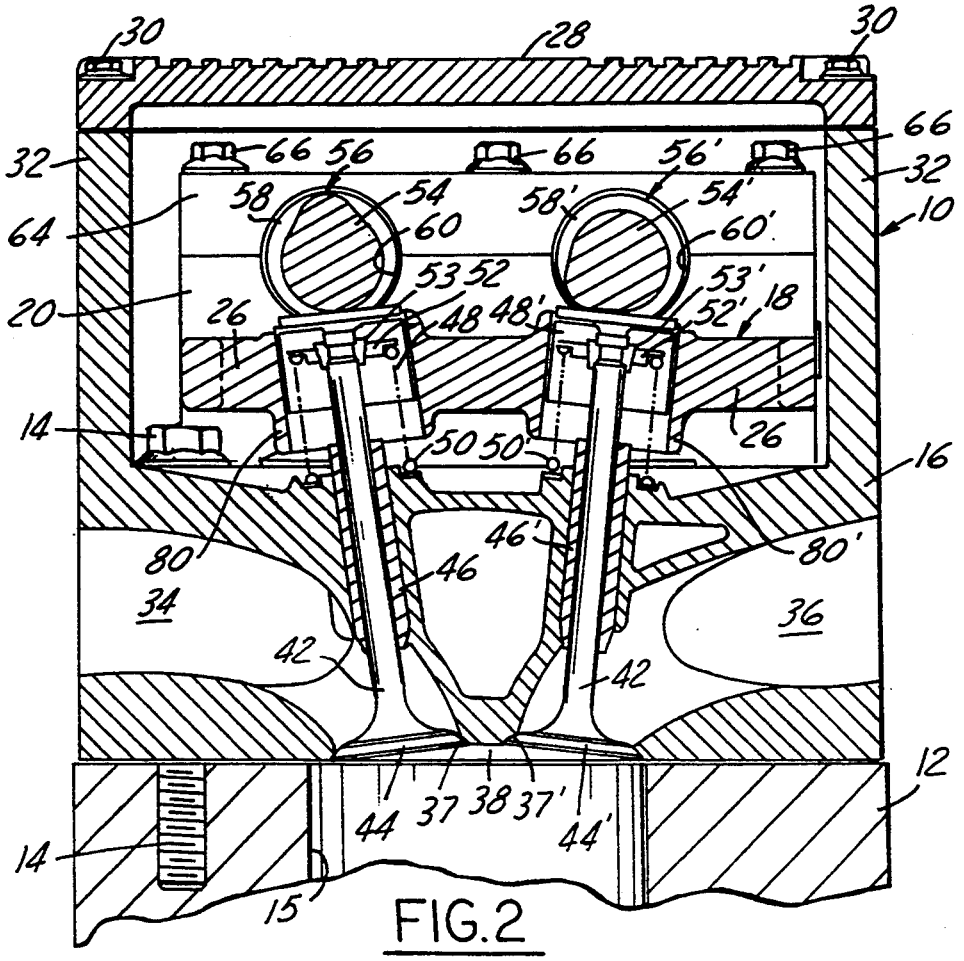
FIG. 2 is a sectional view of the cylinder head of FIG. 1 taken generally along sight lines 2—2 thereof and with intake and exhaust valve construction added.

Turning now in greater detail to the drawings, there is shown in FIGS. 1 and 2 a portion of a cylinder head assembly 10 having an extended length in the longitudinal direction A. The cylinder head 10 is secured to an engine block 12 by threaded fasteners 14 (only one of which is visible). The engine block 12 defines cylinder bores 15 (only one of which is visible in FIG. 2). The head assembly 10 comprises a generally rectilinear (in cross section), cast iron lower base 16 and an upper aluminum or aluminum alloy casting providing a carrier 18 formed by longitudinally spaced bulkheads 20, 22 interconnected in the head's longitudinal direction A by open lattice work 26. A top plate, or valve cover, partially shown at 28, is secured by threaded fasteners 30 to the peripheral and upstanding wall 32 of the lower base forming a closure for the head assembly.

As shown in FIG. 2, the cast iron base 16 has intake and exhaust passages such as shown at 34, 36 formed therein which terminate in openings providing valve seats 37, 37' that communicate with the combustion chamber 38 formed in part in the lower face of the base of the head. These valve openings are opened and closed by valves 42 and 42' having annular heads 44 and 44', elongated stems extending through valve guides 46, 46' supported in the base and mounting inverted bucket-shaped tappets 48, 48' on the upper ends thereof.

Coil springs 50, 50' seated on annular shoulders of the base 16 compass the upper portion of the valve stems and engage spring retainers 52, 52' fixed to upper end portions of the valve stems by locks 53, 53' and provide the spring force to close the intake and exhaust valves.

The valves are displaced inwardly to open positions in which the inlet and exhaust ports are opened by cam lobes 54, 54' respectively secured to overhead camshafts 56, 56' having journals 58, 58' mounted for rotation in the bulkheads 20, 22 of the carrier 18. The camshafts and their cams are rotatably driven by the engine crank through a drive sprocket and timing chain or through gears or belts, not illustrated.

The aluminum carrier 18, best shown in FIG. 1, is elongated in longitudinal direction A and comprises a one-piece member with laterally spaced bulkheads 20, 22 that extend transversely across the base 16 in planes between the cylinders of the engine. The bulkheads have bearings or saddles 60, 60' receiving the journals of the camshaft. Bulkhead caps 62, 64 are mounted over the bulkheads and threaded fasteners 66 secure the caps to the bulkheads and the carrier 18 to the base 16.

The lattice work of the carrier is designed to overlie the base of the head so that tappet support sections axially align with the tappets. The lattice work importantly includes discrete expansion and contraction sections or joints 70, 70' generally U-shaped in top view with spaced legs 74, 74' which lead from connection with the associated bulkhead. The span or link 76 connecting these legs is spaced from the bulkhead and has inboard intermediate connection with generally cylindrical tappet support sections 78, 80 and 78', 80' that are connected therebetween.

The loops of the tappet support sections define cylindrical inner walls to support and guide the cylindrical inverted bucket tappets 48, 48' for reciprocating movement therein.

The lattice work further may include outboard sides 84, 84' that extend longitudinally from bulkhead 22 toward bulkhead 20 but terminate short thereof and connect to transverse arms 86, 86' that in turn connect into the tappet support sections 78, 78'. These arms plus the intermediate arms 88, 88' leading from the sides into connection with the inner loops or support sections 80, 80' of the tappet carrier are effective to stabilize these sections for efficient tappet operation. Further stabilization is provided by the intermediate bridge sections 90, 92 that interconnect the looped tappet support sections to one another.

As best shown in FIG. 2, the tappet carriers or guides are angled with respect to a vertical through the bulkheads to accommodate the angled valves such as valves 42, 42'. The tappet carriers have walls that are greater in height than the side skirts 49, 49' of the buckets of the tappets providing a sturdy segment of the lattice work with improved support of the tappets throughout their stroking length.

It will be seen that in contrast to the other sections of the lattice work, the expansion and contraction sections or joints 70, 70' are relatively thin walled parts of the lattice work. The sections are gaged to flex in a limited region of stress and strain so that they act as an elastic portion of the lattice work to compensate for the differential rate of expansion between the aluminum alloy of the lattice work and the iron base of the head.

Accordingly, it will be appreciated that the bulkheads secure the lattice work in position, and assuming a high temperature operation, such as 200°–350° F., the lattice work will expand relative to the iron base and cause the expansion section to deflect within its limited region of stress and strain so that it behaves as a resilient component when stressed by the expansion or contraction forces. The expansion or contraction energy will in effect be stored in the expansion joint until recovery to its original configuration when the temperatures return to design levels. Furthermore, because of the expansion joints, the bulkheads will not be tilted or stressed by the lattice work when expanding or contracting. This effectively eliminates edge loading of the bulkhead bearings or camshaft journals and high friction and uneven wear is eliminated or sharply reduced.

Figure 3:
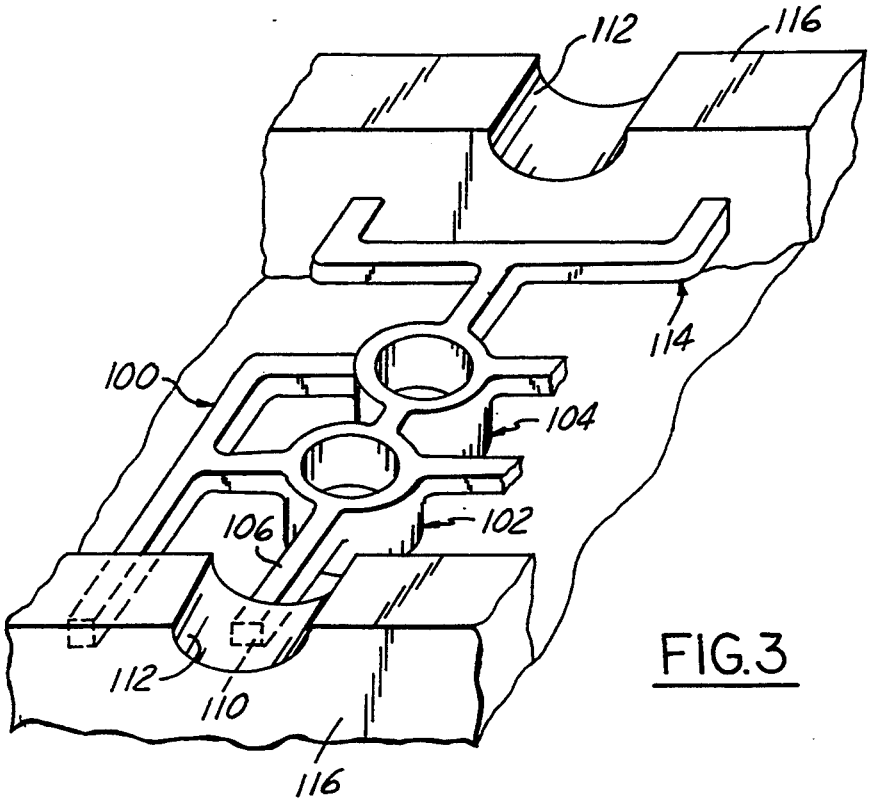
FIG. 3 is a pictorial view of a portion of lattice work of the head for an internal combustion engine illustrating another preferred embodiment of the invention.

The carrier 100 shown in FIG. 3 is similar to that shown in FIGS. 1 and 2 but generally is applicable to a larger and longer engine cylinder head which would provide more space between bulkheads and tappet supports or guide portions. The carrier provides tappet support and guide portions 102, 104, which are connected at one end to bulkhead 108 by a bridge portion 106. The connection 110 to the bulkhead 108 is located below the saddle 112. The carrier assembly is connected at the opposite end to bulkhead 116 through an integral, expansion/contract compensation section 114 which is aligned with bridge 106. The expansion/contraction section 110 is scaled or otherwise dimensioned so that it serves as a resilient expansion and contraction joint operable within its elastic limit to resiliently yield to compensate for expansion and contractions of the carrier relative to the supporting iron base. For example, under elevated temperature conditions, the forces of expansion occurring in the carrier will not be transmitted to the bulkheads with any magnitude that would cause the tilting or displacement thereof. Accordingly, the bearings for the camshaft of the bulkheads and the associated bearing caps are not disturbed and remain in alignment with the camshaft so that there is no undue friction and wear thereof. Also, the flexing of the expansion joint prevents distortion of the bucket supports and guides 102 and 104 so that they continue to operate for effective operation of the head assembly.

Figure 4:
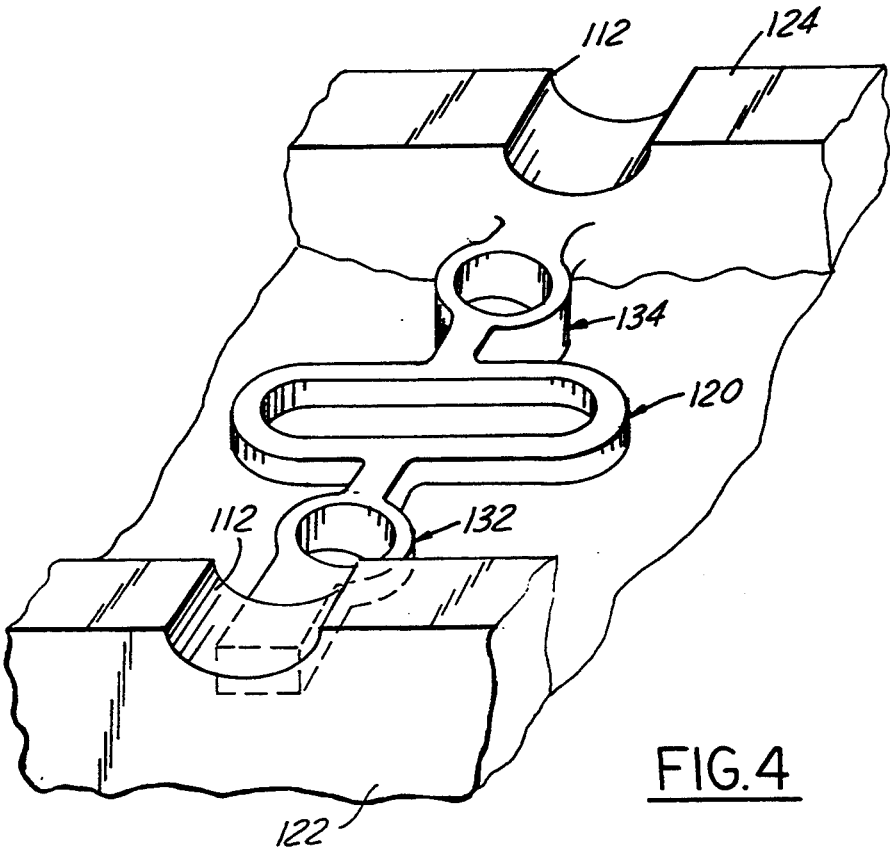
FIG. 4 is a pictorial view similar to that of FIG. 3 illustrating another preferred embodiment of the invention.

FIG. 4 is another preferred embodiment similar to that of FIGS. 1 through 3 but incorporates an oval shaped expansion joint 120 in the aluminum lattice work between the tappet guides 132, 134 and the longitudinally spaced bulkheads 122, 124. As in the previous embodiments, the bulkheads are secured to the iron base of the head and the expansion joint deflects to compensate for the differential rates of expansion of the lattice work and the base. This embodiment is particularly applicable to cylinder heads which have large longitudinal separation between the tappet guides 132, 134, and in which, effectively, such tappet guides are physically attached as an extension of the bulkheads 122, 124, leaving sufficient space therebetween so that an expansion member or loop 120 is located in such empty space.

It will be appreciated that this invention can find use in applications where both the lattice work and lower head are made of aluminum, other materials or alloys thereof having different thermal coefficients of expansion or contractions.

While preferred embodiments of the invention has been shown and described, other embodiments will now become apparent to those skilled in the art. Accordingly, this invention is not to be limited to that which is shown and described but by the following claims.

What is claimed is:

1. A tappet and camshaft carrier of a first metallic material having a first coefficient of thermal expansion for attachment to a base forming the head of an internal combustion engine made from a second metallic material having a second coefficient of thermal expansion which is less than that of the first material, said carrier comprising laterally spaced bulkhead members adapted to be rigidly secured to an outer surface of said base of said head, a lattice work integral with and extending between said bulkhead members, said lattice work including cylindrical support portions for slidably receiving and supporting a tappet therein, said lattice work incorporating an expansion joint between the cylindrical portions and the bulkhead which is adapted to deflect in response to the differential expansion rate of the base and the carrier to compensate for the different rates of expansion of said material of said head and lattice work to eliminate distortions of said carrier in response to variations in temperature effecting expansions and contractions of said carrier and said base portion of said head.

2. A tappet and camshaft carrier of a first metallic material having a first coefficient of thermal expansion and contraction for attachment to the head of an internal combustion engine formed from a second metallic material having a second coefficient of thermal expansion and contraction that is less than that of said first material comprising laterally spaced bulkhead members adapted to be rigidly secured to an outer surface of said head, a lattice work extending between and joining said bulkhead members to one another, said lattice work including cylindrical portions to form a tappet bore for slidably receiving and supporting a tappet therein, said lattice work incorporating an expansion joint therein to flex in response to changes in temperature beyond threshold temperatures to compensate for the different rates of expansion and contraction of said material of said head and said lattice work to eliminate distortion of said bore in response to variations in temperature effecting expansion and contraction of said carrier and said head.

3. The tappet and camshaft carrier of claim 2, wherein said bulkhead and said lattice work are integral.

4. The tappet and camshaft carrier of claim 2, wherein said bulkhead and said lattice work comprise an aluminum alloy casting and said head is iron.

5. The tappet and camshaft carrier of claim 2, wherein said bulkheads have journals formed therein for receiving a camshaft for operating valve members operatively mounted in said head.

6. A tappet and camshaft carrier of a first metallic material having a first coefficient of thermal expansion and contraction for attachment to the head of an internal combustion engine formed from a second metallic material having a second coefficient of thermal expansion and contraction that is less than that of said first material comprising laterally spaced bulkhead members, fasteners for securing said bulkhead members to said head, a lattice work extending over said head and integral with and joining said bulkhead members to one another, and including substantially cylindrical wall portions to form tappet bore means for slidably receiving and supporting tappet means therein, said lattice work having first and second connector portions axially aligned with said tappet bore means for connecting said tappet bore means to said spaced bulkhead members, one of said connector portions having spaced legs with end portions connected to a first of said bulkheads and supporting a link portion extending therebetween in spaced relationship to said from said first bulkhead, said first connector portion forming an expansion joint to flex in response to changes in temperature beyond threshold temperatures to compensate for the different rates of expansion and contraction of said material of said head and said lattice work to eliminate distortion of said bore means in response variations in temperatures effecting expansion and contraction of said carrier, said expansion joint being adapted to recover to its original configuration as the temperatures return to the threshold temperature.

* * * * *